US010801167B2

(12) United States Patent
Laugwitz et al.

(10) Patent No.: US 10,801,167 B2
(45) Date of Patent: Oct. 13, 2020

(54) HAND-GUIDED SOIL COMPACTION MACHINE

(71) Applicant: BOMAG GMBH, Boppard (DE)

(72) Inventors: Niels Laugwitz, Lahnstein (DE); Robert Laux, Neuwied (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 16/320,221

(22) PCT Filed: Jul. 18, 2017

(86) PCT No.: PCT/EP2017/000867
§ 371 (c)(1),
(2) Date: Jan. 24, 2019

(87) PCT Pub. No.: WO2018/019408
PCT Pub. Date: Feb. 1, 2018

(65) Prior Publication Data

US 2019/0234028 A1 Aug. 1, 2019

(30) Foreign Application Priority Data

Jul. 26, 2016 (DE) ..... 10 2016 009 086

(51) Int. Cl.
*E01C 19/00* (2006.01)
*E01C 19/35* (2006.01)
(Continued)

(52) U.S. Cl.
CPC ..... *E01C 19/35* (2013.01); *E01C 19/288* (2013.01); *E01C 19/38* (2013.01); *E02D 3/074* (2013.01); *E02D 3/046* (2013.01)

(58) Field of Classification Search
CPC ..... E01C 19/35; E01C 19/38; E02D 3/074
(Continued)

(56) References Cited

U.S. PATENT DOCUMENTS 6,004,076 A * 12/1999 Cook ..... E01C 19/235 318/128
7,483,791 B2 * 1/2009 Anderegg ..... E01C 19/288 404/117
(Continued)

FOREIGN PATENT DOCUMENTS

DE 202004015141 12/2004
DE 102010060843 5/2012
(Continued)

OTHER PUBLICATIONS

Examination Report from corresponding German Appln. No. 10 2016 009 0863, dated May 19, 2017.
(Continued)

*Primary Examiner* — Raymond W Addie
(74) *Attorney, Agent, or Firm* — Grossman, Tucker, Perreault & Pfleger, PLLC

(57) ABSTRACT

A hand-guided ground compaction machine, in particular a vibratory tamper or vibration plate compactor, having a superstructure, a drive device arranged on the superstructure and having at least one drive shaft, a substructure having a compaction plate driven by the drive device, and a sensor device comprising an accelerometer for determining the ground stiffness of a ground to be compacted, wherein the sensor device is supplied with electrical power, in particular solely, by a generator driven by the at least one drive shaft.

14 Claims, 2 Drawing Sheets

(51) Int. Cl.

| | |
|---|---|
| ***E01C 19/38*** | (2006.01) |
| ***E01C 19/28*** | (2006.01) |
| ***E02D 3/074*** | (2006.01) |
| *E02D 3/046* | (2006.01) |

(58) Field of Classification Search
USPC ..... 404/113, 133.05, 133.1
See application file for complete search history.

(56) References Cited

U.S. PATENT DOCUMENTS

| | | | | |
|---|---|---|---|---|
| 8,057,124 | B2 | 11/2011 | Stenzel et al. | |
| 9,580,879 | B1 * | 2/2017 | Williams | E02D 3/074 404/133.05 |
| 2006/0193693 | A1 * | 8/2006 | Congdon | E01C 19/38 404/133.05 |
| 2012/0076583 | A1 | 3/2012 | Bonnemann | |
| 2013/0051912 | A1 * | 2/2013 | Buschmann | E02F 9/2095 404/83 |
| 2013/0261998 | A1 | 10/2013 | Anderegg et al. | |
| 2015/0191880 | A1 * | 7/2015 | Oetken | E01C 19/282 404/72 |
| 2015/0211199 | A1 * | 7/2015 | Corcoran | E02D 1/00 404/122 |
| 2016/0109858 | A1 * | 4/2016 | Oetken | E01C 19/288 404/84.05 |

FOREIGN PATENT DOCUMENTS

| | | |
|---|---|---|
| DE | 102012017777 | 3/2014 |
| EP | 2243881 | 10/2010 |
| EP | 2627826 | 9/2014 |
| EP | 2434053 | 3/2016 |
| JP | 2009-527664 | 7/2009 |
| JP | 2014-173283 | 9/2014 |
| JP | 2016-079627 | 5/2016 |
| JP | 2016-121478 | 7/2016 |
| WO | 2006/061918 | 6/2006 |

OTHER PUBLICATIONS

English translation of the International Search Report from corresponding PCT Appln. No. PCT/EP2017/000867, dated Oct. 18, 2017.

English translation of the Written Opinion from corresponding PCT Appln. No. PCT/EP2017/000867, dated Oct. 18, 2017.

* cited by examiner

HAND-GUIDED SOIL COMPACTION MACHINE

FIELD

The invention relates to a hand-guided ground compaction machine, in particular a vibratory tamper or a vibration plate compactor.

BACKGROUND

Generic vibratory tampers are known, for example, from EP 2 434 053 B1, and generic vibration plate compactors are known, for example, from DE 10 2012 017 777 A1. They are typically employed in asphalt and earth works to increase the stability of subsoils. To this end, they include a superstructure and a drive device arranged on said superstructure and having at least one drive shaft. The drive device is usually a combustion engine, for example a gasoline, diesel or liquefied gas type combustion engine. Moreover, the generic hand-guided ground compaction machines include a substructure having a compaction plate driven by said drive device. The compaction plate may, for example, be part of a tamper foot in the case of vibratory tampers, and may be a vibratory plate in the case of a vibration plate compactor. The drive device normally drives an oscillation or vibration exciter, which, for example, sets the tamper foot of a vibratory tamper into up-and-down or tamping motion, or sets the vibratory plate of a vibration plate compactor into vibration. Through the tamping motion or the vibration of the respective compaction plate, the ground underneath the hand-guided ground compaction machine is increasingly tightened or compacted. Meanwhile, the hand-guided ground compaction machine can be moved across the ground in a working direction, so that a desired area of a ground can be compacted in this manner.

In particular for hand-guided ground compaction machines which include an electric on-board grid and/or a battery, it is known in the prior art to provide a sensor device for determining the ground stiffness of a ground to be compacted. This is advantageous in particular with respect to optimized efficiency in working operation. For this, the sensor device typically comprises an accelerometer. The ground stiffness increases with increasing compaction, so that an operator can infer that the ground has been compacted sufficiently from reaching a particular ground stiffness. A solution for calculating the ground stiffness during operation of a ground compaction machine is disclosed, for example, in EP 2 627 826 B1. In the prior art, the sensor device and indicating device is powered by the on-board grid or a battery of the hand-guided ground compaction machines. However, there are also hand-guided ground compaction machines, in particular vibratory tampers or vibration plate compactors, which do not include an on-board grid and have no electrical power source that could supply a sensor device. In such hand-guided ground compaction machines, which are of simple design and do not include an on-board grid, such sensor devices for determining the ground stiffness thus cannot be employed. Further, in the known systems for compaction measurement using vibration plate compactors, a sensor is either fixed to the vibrating compaction plate or the sensor is attached to the superstructure of the machine. In the case of attachment to the compaction plate, a cable is required which is particularly well protected in order to resist the rough operating conditions and heavy vibrations. On the other hand, the measuring accuracy is the highest in this case since measurements are taken directly at the work tool. If the sensor is attached to the vibration-isolated superstructure, the ground stiffness can only be measured with reduced accuracy, but the indicating device can be integrated in an advantageous manner and thus the cabling efforts can be reduced. Still, cabling cannot be fully dispensed with in this case since a power supply is needed.

SUMMARY

The object of the invention is therefore to propose a solution for operating a sensor device for determining the ground stiffness of a ground to be compacted in particular also in hand-guided ground compaction machines of simple design, and at minimum costs.

For a hand-guided ground compaction machine as mentioned above, the object is specifically achieved by the fact that the sensor device is provided with electrical power, in particular solely, by a generator driven, in particular directly, by the at least one drive shaft. Further, it is particularly preferred here that the generator supplies electrical power solely to the sensor device. The generator may, for example, comprise a dynamo or operate according to the dynamo principle. The generator is typically designed such that it utilizes a rotational movement for generating electrical power. The required rotational movement is provided, in particular directly, by the drive device driving a drive shaft to which the generator is connected, in particular directly. The drive device sets the drive shaft into rotation, which rotation is in turn transferred to the generator, which thereby generates electrical power. A configuration in which the generator supplies electrical power solely to the sensor device and in particular forms a unit together with the sensor device has proven to be particularly advantageous. This unit composed of generator and sensor can be mounted collectively as a complete assembly group without additional cable connections being required. Such an electrical power supply to the sensor device has turned out to be particularly reliable and is moreover particularly compact, essentially maintenance-free since it is not necessary, for example, to replace batteries driving the sensor device, and, in addition, is suitable for retrofitting, as will be described in more detail below. Due to the fact that the generator is driven through operation of the drive device, a constant supply of electrical power to the sensor device is ensured at least, and in particular solely, during working operation of the ground compaction machine. The hand-guided ground compaction machine does therefore not need to be equipped with a complete on-board grid, in particular comprising a battery, i.e., the sensor device can be operated independently of an on-board grid. Due to the fact that the sensor device according to the invention and the generator are simply coupled to one of the drive shafts of the ground compaction machine, the invention can be realized in a cost-effective manner even in ground compaction machines of simple design. An "on-board grid" means in particular a unit or a system having an electrical power storage, for example an accumulator, in particular a lead accumulator. Moreover, the on-board grid may comprise an electric generator for charging the electrical power storage. With the charge in the electrical power storage, the on-board grid supplies various electric components but does in particular not supply the sensor device according to the invention.

One way to drive the generator consists in concurrently utilizing the drive shaft itself also as a shaft for the generator, for example by attaching magnets, in particular permanent magnets, directly on the drive shaft, said magnets projecting into a corresponding stator element of the sensor device so as to form a dynamo unit. Further, a connection element may be present, for example a coupling. Preferably, however, the connection element is a through-drive shaft which connects the at least one drive shaft and the generator to one another, so that the rotational movement of the drive shaft is transferred to the generator via the through-drive shaft. The through-drive shaft is a component which is axially fixed to the drive shaft, i.e. to a face side of the drive shaft, and transfers the rotational movement of the drive shaft to the generator, i.e. makes said rotational movement usable for the generator, for example a connection pin, in particular a polygonal connection pin. The through-drive shaft thus at least partially constitutes a coaxial extension of the drive shaft.

In a preferred embodiment, the sensor device, or the generator, directly adjoins, or overlaps with, the face side of the drive shaft in the axial direction of the drive shaft. However, if the superstructure of the ground compaction machine is at least partially surrounded by a housing, for example the drive device or the drive shaft, it is preferred that the generator, and in particular also the sensor device, is arranged outside a housing of the superstructure, and that the through-drive shaft extends through the housing. In other words, the drive shaft is located inside a housing of the superstructure. The generator, and in particular also the sensor device, are arranged outside the housing, thus facilitating mounting and maintenance thereof. To enable the generator to be driven and thus the sensor device to be supplied with electrical power, the through-drive shaft is preferably lead through the housing, i.e, through the housing wall, and connects the drive shaft, in particular its face side, to the generator. In this manner, the sensor device can also be seen from outside and may, for example, additionally comprise an indicating device indicating the measured values and/or the ground stiffness and/or an indication which correlates with the ground stiffness.

The at least one drive shaft may preferably be a crankshaft directly driven by the drive device. In other words, in order to supply electrical power to the sensor device, the generator is driven by the crankshaft of the drive device directly or via the through-drive shaft. A drive device may be provided which has a crankshaft that exits on only one side of the drive device. In this case, this crankshaft is utilized for driving the generator. On the other hand, it is also possible that the drive device is designed such that the crankshaft exits the drive device on two opposite sides thereof. This design is preferred in particular when the exciter unit for oscillation or vibration excitation is arranged, and driven, on the one side of the drive device, so that there is no space left on this side for the generator, or the generator and the sensor device. In this case, the generator is then driven by the other end of the crankshaft, which exits on the opposite side of the drive device. The generator is thus driven by a portion of the crankshaft which exits the drive device opposite from a further portion of the crankshaft which drives the exciter unit of the ground compaction machine. In this manner, the generator, and thus the sensor device according to the invention, can be driven by the crankshaft even in constricted space conditions as found in particular, for example, in vibratory tampers.

As an alternative to the drive effected via the crankshaft, the at least one drive shaft may be an eccentric shaft or imbalance shaft driven by an eccentric transmission or an imbalance transmission. For example, in the case of vibratory tampers, the tamping motion of the tamping foot is typically achieved through rotation of an eccentric wheel having a connecting rod eccentrically fixed to it, said connecting rod translating the rotational movement into a linear up-and-down movement of the tamping foot. The eccentric wheel sits on an eccentric shaft which is driven, via an eccentric transmission, for example a pinion meshing with the eccentric wheel, by the drive device, in particular via the crankshaft. In other words, the eccentric shaft constitutes a further rotating shaft which is present in the superstructure of the vibratory tamper in addition to the crankshaft. This eccentric shaft now can also be used to drive the generator and thus to supply electrical power to the sensor device. The vibration plate compactors are usually set into vibration or oscillation by a rotating imbalance mass. Said imbalance mass is located on an imbalance shaft which is driven by the drive device, for example the crankshaft of the drive device, via a transmission (for example a belt transmission or a hydraulic power transmission). In a vibration plate compactor, it is thus possible to use a further rotating shaft, in this case the imbalance shaft, in addition to the crankshaft of the drive device to drive the generator and thus to supply electrical power to the sensor device. The connection of the generator to the respective shaft then corresponds to the embodiments described above. Generally, the generator may be driven by any shaft of the hand-guided ground compaction machine which is fixed to the housing.

The rotational movement of the crankshaft is transferred to the eccentric shaft or the imbalance shaft via the eccentric transmission or the imbalance transmission. The eccentric shaft or the imbalance shaft may therefore include an eccentric axis or imbalance axis which is offset, in particular parallel, relative to a drive axis of the crankshaft of the drive device. The offset between the respective rotation axes is overcome by the eccentric transmission or the imbalance transmission. The eccentric axis or the imbalance axis may thus be in a different position inside the ground compaction machine depending on the design of the corresponding transmissions. A variety of different options thus exists for coupling the generator to the respective shaft, so that the respective design can be adapted to the specific space conditions of the ground compaction machine, in particular the superstructure.

In practice, it has proven to be advantageous that the sensor device comprises a transmitting device which is designed for wireless transmission of the measurement results of the sensor device to a mobile receiving device. The mobile receiving device may, for example, be a tablet computer or a smartphone, which is usually already available to the operator of the hand-guided ground compaction machine anyway. If compatible data transmission, for example WLAN, is used, such a mobile terminal may be employed as a receiving device if it is already carried by the operator of the ground compaction machine anyway. For example, through installation of a simple app, a smartphone or a tablet computer may be adapted to receive, and possibly evaluate, the data of the transmitting device of the sensor device. In this manner, no separate indicating device or evaluation device is needed at the hand-guided ground compaction machine. In particular, a power supply for the indicating device can be dispensed with since the mobile receiving device normally has its own power storage.

The invention is in particular also suitable for retrofitting existing hand-guided ground compaction machines, whether with or without an existing power source. Both the sensor device and the generator and its drive connection are optimized for incorporation into existing systems since, for example, no integration into on-board electronics or other structures is necessary. Also, the components are very compact and can be easily integrated also with respect to the required free installation space. A further preferred embodiment of the invention therefore relates to a hand-guided ground compaction machine having at least one further generator which supplies electrical power to other components of the hand-guided ground compaction machine, for example spark plugs, wherein the sensor device is supplied with electrical power solely by the first generator, and wherein the latter preferably supplies electrical power solely to the sensor device. The generator and the supply of the sensor device with electrical power are thus designed to be electrically completely separated from all other electric components of the hand-guided ground compaction machine. More particularly, the sensor device obtains its required power solely from the generator operated as explained above and is completely independent of any further power source such as a further generator or a battery or an accumulator. In this manner, the sensor device according to the invention, together with the corresponding generator, is also suitable for use as a retrofit kit for already existing hand-guided ground compaction machines regardless of whether or not they already include electronics. The sensor device according to the invention can be employed together with the generator on all hand-guided ground compaction machines regardless of this.

This can be done particularly easily if the sensor device and the generator supplying it with electrical power are jointly designed as a module or as an integral, in particular compact, assembly unit, and in particular as a retrofit kit. To this end, the sensor device and the generator particularly preferably share a common housing and/or a common fixing device for fixation to the remaining ground compaction machine. They are thus preferably designed to be mountable to a hand-guided ground compaction machine together as a discrete assembly group, so that they merely need to be connected to the drive shaft, for example via the through-drive shaft, and fixed, for example, to the housing at the superstructure. In this manner, it is possible to also equip older existing hand-guided ground compaction machines with a sensor device according to the invention, and in particular with state of the art ground stiffness determination.

In a preferred embodiment, the sensor device comprises a storage unit. The measurement data of the sensor device are continuously stored in the storage unit and can be read therefrom. The storage unit enables in particular the acquisition and monitoring of long-term trends and operating hours. The storage unit may also be provided as a unit separate from the sensor device and may receive the measurement results from the latter, for example as part of the mobile receiving device.

According to another embodiment, the sensor device is equipped with a bidirectional radio interface which enables wireless configuration of the sensor device. The sensor device is thus designed not only to send measurement results but also to receive and implement configuration commands via which various functions of the sensor device can be selected. For example, the mobile receiving device is designed to send such configuration commands upon an input by an operator.

Particularly low manufacturing costs can be achieved if the sensor device is constructed in the same way for a maximum variety of different compacting devices. Any required adaptations are performed through software parameterization via a bidirectional sending/receiving device of the sensor device. No manual intervention is thus required at the sensor device as the necessary parameters are input via the mobile terminal. The process of parameterization can be facilitated through machine-readable codes such as barcodes or QR codes, i.e., by reading these codes from the corresponding components such as the compacting device and/or the sensor device.

Additional benefits can be obtained from associating measurement data of the sensor device with information of the mobile receiving device. Here, for example, the position data of the receiving device and the period of operation of the compacting device can enable a documentation of the machine operation. For example, if the achievable productive capacity in $m^3/h$ is known, the recorded actual working time of the compaction machine can be used to ascertain whether an amount of laid material has actually been compacted.

By comparing an actual working time, which can be detected through the sensor system, and the motor operating time, unnecessary idle times can be detected and avoided in the future. Conventional operating hour meters merely acquire the motor operating time and therefore only provide an indication of necessary motor maintenance intervals. Unproductive idle times can hardly be detected in the conventional manner.

The compaction indication and additional functions may also be provided in a time and place-limited manner via Internet-based authorization. In this manner, it would be possible to integrate the sensor device as a standard device in the compacting device and to enable the indication of the compaction or further data depending on the payment of user fees. Another conceivable option would be location monitoring such that the sensor device periodically reports the place of operation of the machine via WLAN-based positioning as soon as a corresponding infrastructure is present. An anti-theft protection can thus be implemented in a simple manner.

BRIEF DESCRIPTION OF THE DRAWINGS

The invention will be explained in more detail below by reference to the embodiment examples shown in the figures. In the schematic figures.

DETAILED DESCRIPTION

Figure 1:
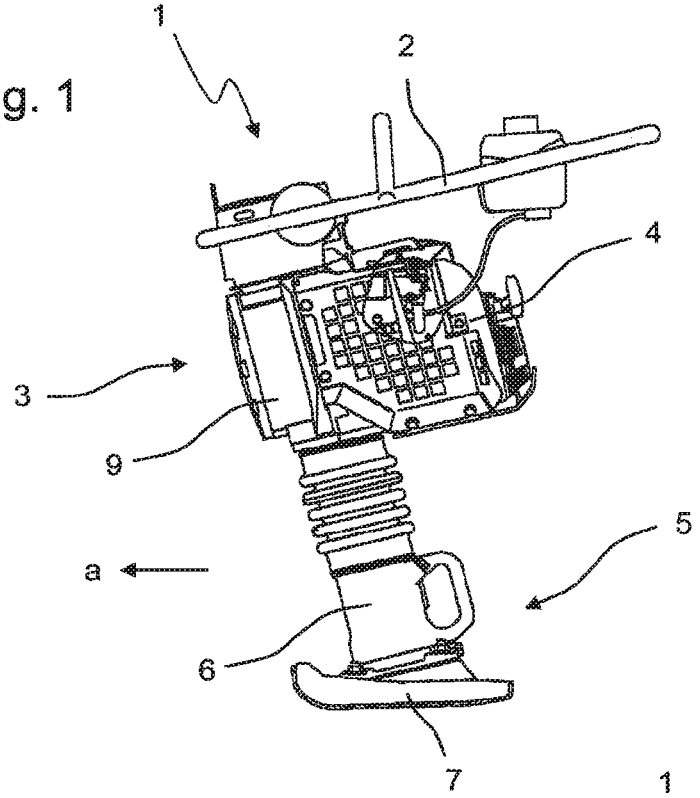
FIG. 1 is a side view of a vibratory tamper.

Like parts or parts acting in a like manner are designated by like reference numerals. Recurring parts are not designated separately in each figure.

Figure 2:
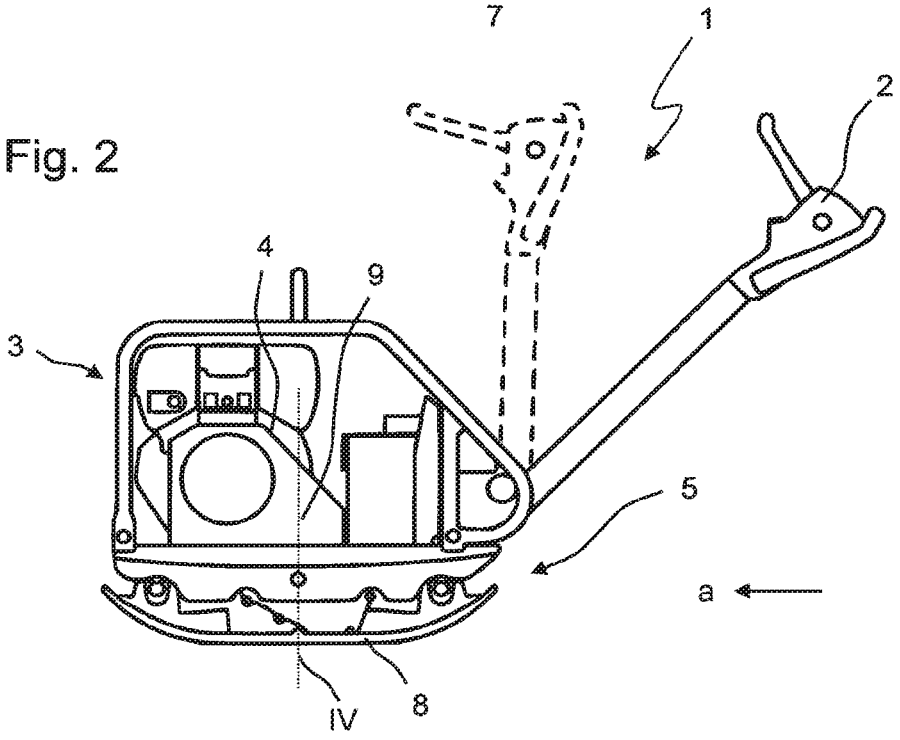
FIG. 2 is a side view of a vibration plate compactor.

FIGS. 1 and 2 show generic hand-guided ground compaction machines 1, more specifically a vibratory tamper (FIG. 1) and a vibration plate compactor (FIG. 2). Each of the hand-guided ground compaction machines 1 includes a guide bracket 2 with which an operator can direct the ground compaction machine 1 across the ground during working operation. The guide bracket 2 of the vibration plate compactor shown in FIG. 2 can be folded to a transport position, as indicated by the dashed lines. The hand-guided ground compaction machines 1 include a superstructure 3 in which a drive device 4 is located, which is usually a combustion engine, for example a diesel or gasoline or liquefied gas type combustion engine. Moreover, the ground compaction machines 1 include a substructure 5 having a compaction plate 7, 8. In the case of the vibratory tamper, the compaction plate 7 is designed as a tamping plate which constitutes the lower end, i.e., the end facing the ground, of the tamper foot 6. The compaction plate 8 is a ground contacting plate in the form of a vibratory plate. In working operation of the hand-guided ground compaction machines 1, the compaction plates 7, 8 are set into oscillation or vibration by the drive device 4. An operator guides the ground compaction machines 1 across the ground, for example in the working direction a, thereby causing compaction of the subsoil. In the embodiment example shown, the superstructure 3 of the hand-guided ground compaction machines 1 includes a respective housing 9 which includes various components of the ground compaction machines 1.

Figure 3:
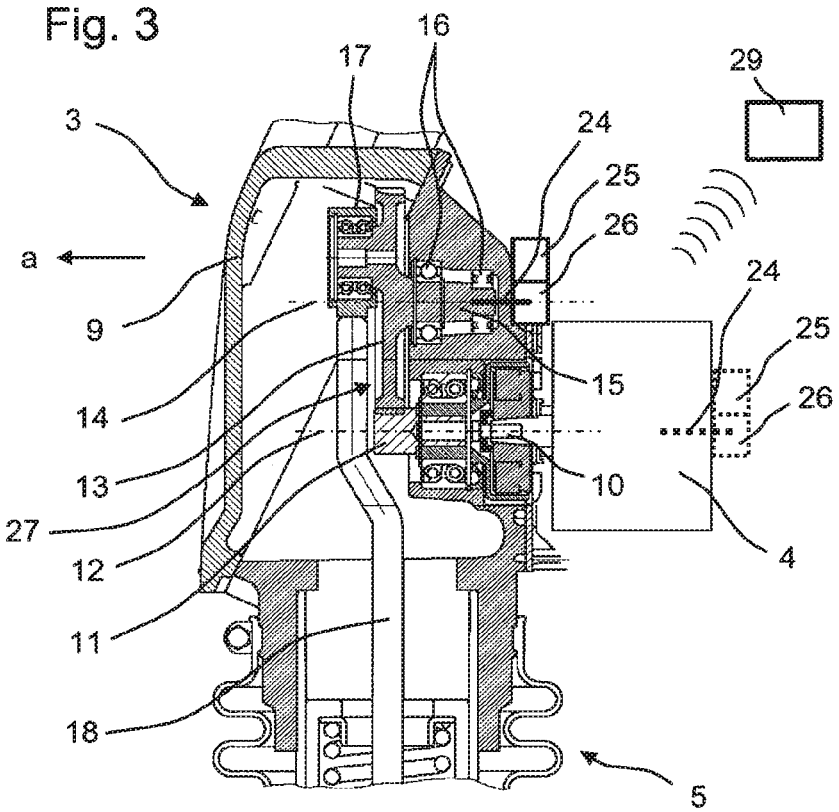
FIG. 3 is a cross-sectional view of the superstructure of a vibratory tamper.

FIG. 3 shows a cross-sectional view of the superstructure 3 of the vibratory tamper of FIG. 1. FIG. 3 in particular shows the components of the vibratory tamper inside the housing 9. The drive unit 4 sets the crankshaft 10 into rotation about the drive axis 12. More particularly, the drive device 4 drives, via the crankshaft 10, a pinion 11 which likewise rotates about the drive axis 12 and meshes with an eccentric wheel 13, which is thereby likewise set into rotation by the pinion 11. The eccentric wheel 13 rotates about the eccentric axis 14. To realize this rotational movement, the eccentric wheel 13 includes an eccentric shaft 15 which is rotatably supported at the housing 9 via eccentric bearings 16. An eccentric joint 17, via which a connecting rod 18 is fixed to the eccentric wheel 13, is located at an eccentric position on the eccentric wheel 13. In working operation of the vibratory tamper, the eccentric wheel 13 rotates, thereby setting the connecting rod 18 into a uniform up-and-down movement. The connecting rod 18 transfers this up-and-down movement to the tamper foot 6, thus driving the compaction plate 7. The pinion 11 and the eccentric wheel 13 together form the eccentric transmission 27, which drives the eccentric shaft 15. In other words, the eccentric transmission 27 transfers the rotational movement of the crankshaft 10 of the drive device 4 to the eccentric shaft 15. The eccentric shaft 15 then rotates about the eccentric axis 14, which is offset parallel to the drive axis 12 about which the crankshaft 10 rotates.

In the shown embodiment of the invention according to FIG. 3, a through-drive shaft 24 is arranged on the face side of the eccentric shaft 15 opposite the eccentric wheel 13, said through-drive shaft extending through the housing 9 and being connected to a generator 26 of a sensor device 25 which is designed to determine the ground stiffness of the ground to be compacted. The through-drive shaft 24 functionally extends the eccentric shaft 15 axially at its face side and transfers the rotational movement from the eccentric shaft 15 to the generator 26, whereby the generator 26 produces an electric current which is used to supply the sensor device 25 and in particular its accelerometer and transmitting device. The generator 26 and the sensor device 25 are arranged outside the housing 9. On the one hand, this location provides sufficient space on the vibratory tamper to accommodate the components, and, on the other hand, this enables an operator to access the sensor device 25 and the generator 26 from the outside, for example, for maintenance purposes. It also allows easy mounting of the sensor device 25 and the generator 26 from the outside. The generator 26 and the sensor device 25 are further designed as an integral module with a shared housing surrounding these two elements.

FIG. 3 also shows an alternative embodiment of the invention in which the through-drive shaft 24, the generator 26 and the sensor device 25 are driven by the crankshaft 10 of the drive motor. According to this alternative, the through-drive shaft 24 is arranged on the face side of the crankshaft 10 opposite the pinion 11, wherein said crankshaft 10 exits the drive device 4 on two opposite sides. Here, the through-drive shaft 24 is driven by that side of the crankshaft 10 which is not connected to the pinion 11. The through-drive shaft 24 is connected directly to the crankshaft 10 such that the crankshaft 10 sets the through-drive shaft 24 into rotation, so that the latter drives the generator 26. Again, this region of the second side of the crankshaft 10 exiting the drive device 4 provides sufficient space at the vibratory tamper to arrange the sensor device 25 according to the invention together with the generator 26. Due to their construction, vibratory tampers exhibit enormous accelerations even at the superstructure, said accelerations highly depending on the stiffness of the subsoil to be compacted. The attachment of the sensor unit in the described manner is therefore advantageous in various respects. The measurement of the oscillations of the tamper superstructure provides for sufficiently accurate measurement of the ground stiffness, while at the same time the power supply of the sensor device can be realized in a particularly simple manner.

Figure 4:
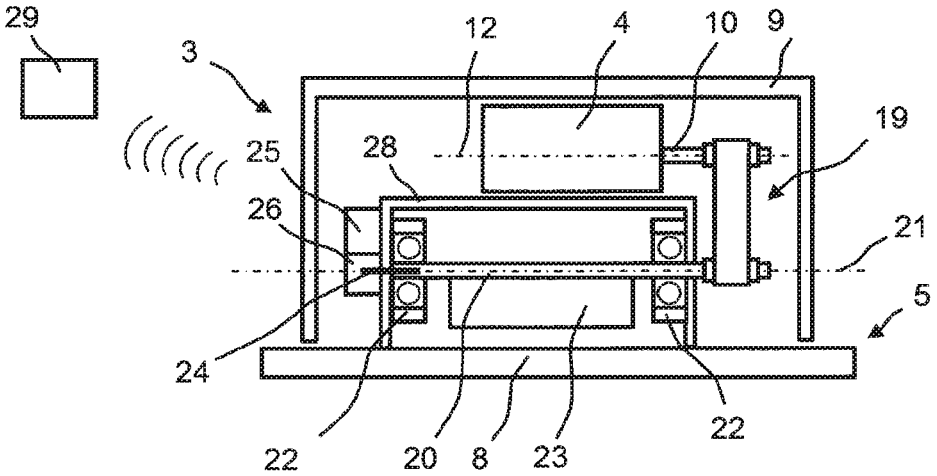
FIG. 4 is a cross-sectional view of a vibration plate compactor along line IV of FIG. 2.

FIG. 4 is a partial cross-sectional view of the vibration plate compactor according to line IV of FIG. 2. The housing 9 of the superstructure 3 of the vibration plate compactor again contains a drive device 4 which drives a crankshaft 10 about a drive axis 12. The crankshaft 10 is in turn connected to an imbalance shaft 20 via an imbalance transmission 19 and sets the imbalance shaft 20 into rotation about the imbalance axis 21. In the example shown, the imbalance transmission 19 is designed as a belt transmission, although it might also be a gear wheel transmission or the like. The imbalance shaft 20 is supported at an imbalance mass housing 28 via imbalance bearings 22 and carries an imbalance mass 23 which is located inside the imbalance mass housing 28. Rotation of the imbalance shaft 20 also sets the imbalance mass 23 into rotation about the imbalance axis 21, which sets the compaction plate 8 into oscillation or vibration. As already explained for the vibratory tamper, via the through-drive shaft 24, the sensor device 25 according to the invention and the generator 26 may generally be arranged at any shaft fixed to the housing. For example, according to one embodiment, the through-drive shaft 24 is arranged on a face side of the eccentric shaft 20. The through-drive shaft 24 extends through the imbalance mass housing 28, i.e., the housing wall of the imbalance mass housing 28, and transfers the rotation of the imbalance shaft 20 about the imbalance axis 21 to the generator 26, which is thereby driven and produces electrical power for the sensor device 25. Due to their construction, vibration plate compactors exhibit considerably dampened vibrations at the superstructure, which are only of limited use for measuring the ground stiffness. This is caused, for example, by vibration decoupling of the imbalance mass housing 28 from the housing 9, for example via rubber members. The attachment of the sensor device 25 directly to the imbalance shaft 20 is therefore advantageous in various respects. The measurement of the oscillations at the imbalance mass housing 28 of the vibration plate compactor provides for particularly accurate measurement of the ground stiffness while at the same time the power supply of the sensor device 25 can be realized in a particularly simple manner since sensitive cable connections are dispensed with. The direct attachment of the sensor device 25 to the imbalance shaft 20 also enables the cost-effective integration of further functions. For example, it is expedient to integrate a condition monitoring device for the vibration bearings 22 into the sensor device 25. The condition monitoring could, for example, be performed by directly or indirectly measuring the bearing temperature. Also, rolling bearing-typical frequencies could be extracted from the acceleration signal, so that possible damage could be detected automatically through evaluation of these signal components. A further additional function may consist in determining the actual working time with the machine. Since the sensor device 25 is supplied by a dedicated generator 26, only the actual operating hours of the machine, i.e., without any idle times, are acquired. It is thus possible, for example, to extend the maintenance intervals for the exciter unit since the actual period of operation of the machine can be acquired separately from the idle times.

As also shown in FIGS. 3 and 4, the sensor device 25 is equipped with a transmitting device which communicates the measurement results of the sensor device 25 and/or the calculated ground stiffness values to a receiving device 29, in particular a mobile receiving device 29. The mobile receiving device 29 is, for example, a tablet computer or a smartphone of an operator of the hand-guided ground compaction machines 1, which executes a program, for example an app, designed to indicate and/or evaluate the measuring signals and/or the calculated ground stiffness values. Therefore, the hand-guided ground compaction machines 1 do not require a separate indicating device, so that no further modifications of the ground compaction machines 1 are necessary and construction costs for the realization of the invention are kept low.

As can further be taken from FIGS. 3 and 4, the sensor device 25 and the generator 26 are designed as a module. The sensor device 25 and the generator 26 form an integral component, or a discrete assembly group, which can altogether be mounted on the hand-guided ground compaction machine 1, i.e., the housing 9, at the corresponding mounting position. All components are thus mounted together in only one step. To install the sensor device 25 according to the invention and the generator 26 on a hand-guided ground compaction machine 1, it is merely necessary to connect the through-drive shaft 24 to a drive shaft 10, 15, 20 and to fix the unit composed of the sensor device 25 and the generator 26 to the ground compaction machine 1, i.e., the housing 9. The invention is therefore also suitable in particular for use as a retrofit kit for any type of existing hand-guided ground compaction machine 1, regardless of whether it includes an electrical power supply, an on-board grid or any electronics at all.

What is claimed is:

1. A ground compaction machine, the machine comprising:

the ground compaction machine being a hand-guided ground compaction machine, the hand-guided ground compaction machine having an operator guide bracket with which an operator directs the hand-guided ground compaction machine across ground during working operation;

a superstructure;

a drive device arranged on the superstructure and having at least one drive shaft;

a substructure having a compaction plate driven by said drive device;

a sensor device comprising at least one accelerometer for determining the ground stiffness of a ground to be compacted, wherein the sensor device is supplied with electrical power solely by a generator driven by said at least one drive shaft;

an on-board grid; and wherein the sensor device is operable independently of the on-board grid and the generator supplies electrical power solely to the sensor device.

2. The ground compaction machine according to claim 1, wherein the at least one drive shaft is a crankshaft driven directly by the drive device.

3. The ground compaction machine according to claim 1, wherein the sensor device comprises a transmitting device which is designed for wireless transmission of the measurement results of the sensor device to a mobile receiving device.

4. The ground compaction machine according to claim 1, wherein it includes a further generator which supplies power to other components of the hand-guided ground compaction machine, wherein the sensor device is supplied with electrical power solely by the first generator.

5. The ground compaction machine according to claim 1, wherein the sensor device and the generator supplying it with power are jointly designed as a module and as a retrofit kit.

6. The ground compaction machine according to claim 1, wherein the sensor device includes a storage unit with which long-term trends and operating hours can be acquired.

7. The ground compaction machine according to claim 1, wherein the sensor device is equipped with a bidirectional radio interface which enables wireless configuration of the sensor device.

8. The ground compaction machine according to claim 1, wherein the hand-guided ground compaction machine is a vibratory tamper or a vibration plate compactor.

9. The ground compaction machine according to claim 1, wherein a through-drive shaft connects the at least one drive shaft and the generator, and the generator is driven by the at least one drive shaft via said through-drive shaft.

10. The ground compaction machine according to claim 9, wherein the generator and also the sensor device, are arranged outside a housing of the superstructure or an imbalance mass housing, and the through-drive shaft extends through said housing or said imbalance mass housing.

11. The ground compaction machine according to claim 1, wherein the at least one drive shaft is an eccentric shaft or an imbalance shaft driven by the drive device via an eccentric transmission or an imbalance transmission.

12. The ground compaction machine according to claim 11, wherein the eccentric shaft or the imbalance shaft includes an eccentric axis or imbalance axis which is offset and parallel, relative to a drive axis of the crankshaft of the drive device.

13. A ground compaction machine which excludes an on-board grid, the machine comprising:

the ground compaction machine being a hand-guided ground compaction machine, the hand-guided ground compaction machine having an operator guide bracket with which an operator directs the hand-guided ground compaction machine across ground during working operation;

a superstructure;

a drive device arranged on the superstructure and having at least one drive shaft;

a substructure having a compaction plate driven by said drive device;

a sensor device comprising at least one accelerometer for determining the ground stiffness of a ground to be compacted, wherein the sensor device is supplied with electrical power solely by a generator driven by said at least one drive shaft;

wherein the sensor device is operable in an absence of the on-board grid; and wherein the generator supplies electrical power solely to the sensor device.

14. A hand-guided ground compaction machine, the machine comprising:

a superstructure;

a drive device arranged on the superstructure and having at least one drive shaft;

a substructure having a compaction plate driven by said drive device;

a sensor device comprising at least one accelerometer for determining the ground stiffness of a ground to be compacted, wherein the sensor device is supplied with electrical power solely by a generator driven by said at least one drive shaft;

wherein a through-drive shaft connects the at least one drive shaft and the generator, and the generator is driven by the at least one drive shaft via said through-drive shaft; and wherein the generator and the sensor device are arranged outside a housing of the superstructure or an imbalance mass housing, and the through-drive shaft extends through said housing or said imbalance mass housing.

* * * * *